United States Patent [19]

Jackson

[11] Patent Number: 4,719,933

[45] Date of Patent: Jan. 19, 1988

[54] MACHINE FOR WASHING PARTICULATE WORKPIECES

[75] Inventor: Warren M. Jackson, Rockford, Ill.

[73] Assignee: Warren M. Jackson, Inc., Rockford, Ill.

[21] Appl. No.: 939,080

[22] Filed: Dec. 8, 1986

[51] Int. Cl.[4] ..... B08B 3/02

[52] U.S. Cl. ..... 134/65; 134/132; 210/167; 198/658

[58] Field of Search ..... 134/65, 104, 132; 68/27, 58, 143, 145; 198/357, 358; 210/167, 242.4

[56] References Cited

U.S. PATENT DOCUMENTS

| | | | |
|---|---|---|---|
| 1,837,069 | 12/1931 | Rieger | 198/657 |
| 3,552,405 | 1/1971 | Apel | 134/65 |
| 4,097,379 | 6/1978 | Shelstad | 210/167 |
| 4,098,225 | 7/1978 | Norman | 134/65 |
| 4,165,994 | 8/1979 | Jackson | 134/104 |

*Primary Examiner*—Harvey C. Hornsby
*Assistant Examiner*—Corinne Reinckens
*Attorney, Agent, or Firm*—Leydig, Voit & Mayer

[57] ABSTRACT

Screws are delivered into the entrance end of a rotating horizontal drum and are advanced axially through the drum by an annular helical conveyor flight extending around and along the inner wall of the drum. During the advance, the screws are sprayed with a hot cleaning solution to remove oil from the screws, the screws being dried by heating coils prior to being discharged from the drum. A shield at the entrance end of the drum prevents screws from becoming trapped between the end of the drum and the initial turn of the conveyor flight as the screws are delivered into the drum. The cleaning solution sprayed into the drum is returned to a reservoir where oil is seperated from the solution by means of a rotating disc which attracts and picks up the oil and by means of squeegee blades which scrape oil from opposite sides of the disc for discharge to a drain.

13 Claims, 8 Drawing Figures

MACHINE FOR WASHING PARTICULATE WORKPIECES

BACKGROUND OF THE INVENTION

This invention relates to a machine for cleaning contaminants from workpieces and, more particularly, to a machine for washing lubricant from particulate workpieces such as newly formed screws.

One type of machine for washing screws or the like is disclosed in Jackson U.S. Pat. No. 4,165,994. In that machine, a cleaning solution is sprayed into a tub which holds a batch of screws and which spins about an upright axis to wash and then dry the screws. In another type of machine, particulate workpieces are washed as they are advanced continuously through a drum which is rotated about a generally horizontal axis. A helical conveyor flight is secured to the inner wall of the drum and advances the workpieces axially within the drum as the latter rotates.

The present invention relates to a parts washing machine of the horizontal drum type. More particularly, the invention relates to a machine in which the parts are introduced into the drum through an opening in a ring at the entrance end of the drum, the parts then being picked up by the helical conveyor flight for advancement through the drum.

SUMMARY OF THE INVENTION

The general aim of the present invention is to provide a new and improved drum-type parts washing machine in which the danger of newly introduced parts becoming captivated between the end ring of the drum and the first turn of the helical conveyor flight is eliminated so as to promote free movement of parts at the entrance end of the drum.

A more detailed object of the invention is to achieve the foregoing by providing a novel shield for covering the space between the end ring and the first conveyor turn so as to prevent parts from becoming trapped in such space.

The invention also resides in the unique configuration of the shield to direct certain parts beyond the first turn of the helical conveyor and into operative association with the second turn.

Still another object of the invention is to provide novel means for separating lubricant from the cleaning solution and for discharging such lubricant from the system.

These and other objects and advantages of the invention will become more apparent from the following detailed description when taken in conjunction with the accompanying drawings.

DETAILED DESCRIPTION OF THE PREFERRED EMBODIMENT

Figure 5:
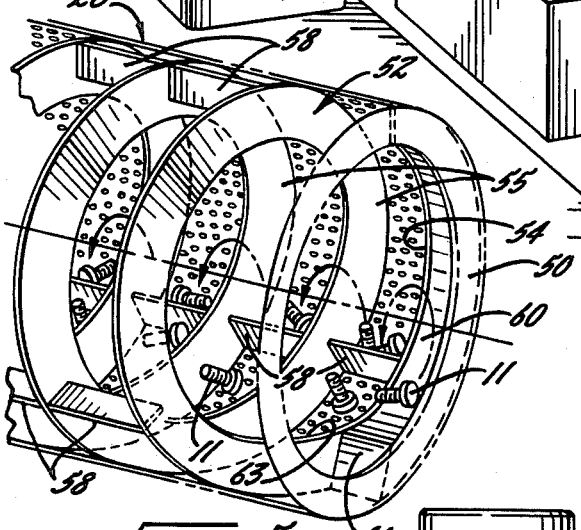
FIG. 5 is a perspective view of the entrance portion of the drum.
Figure 2:
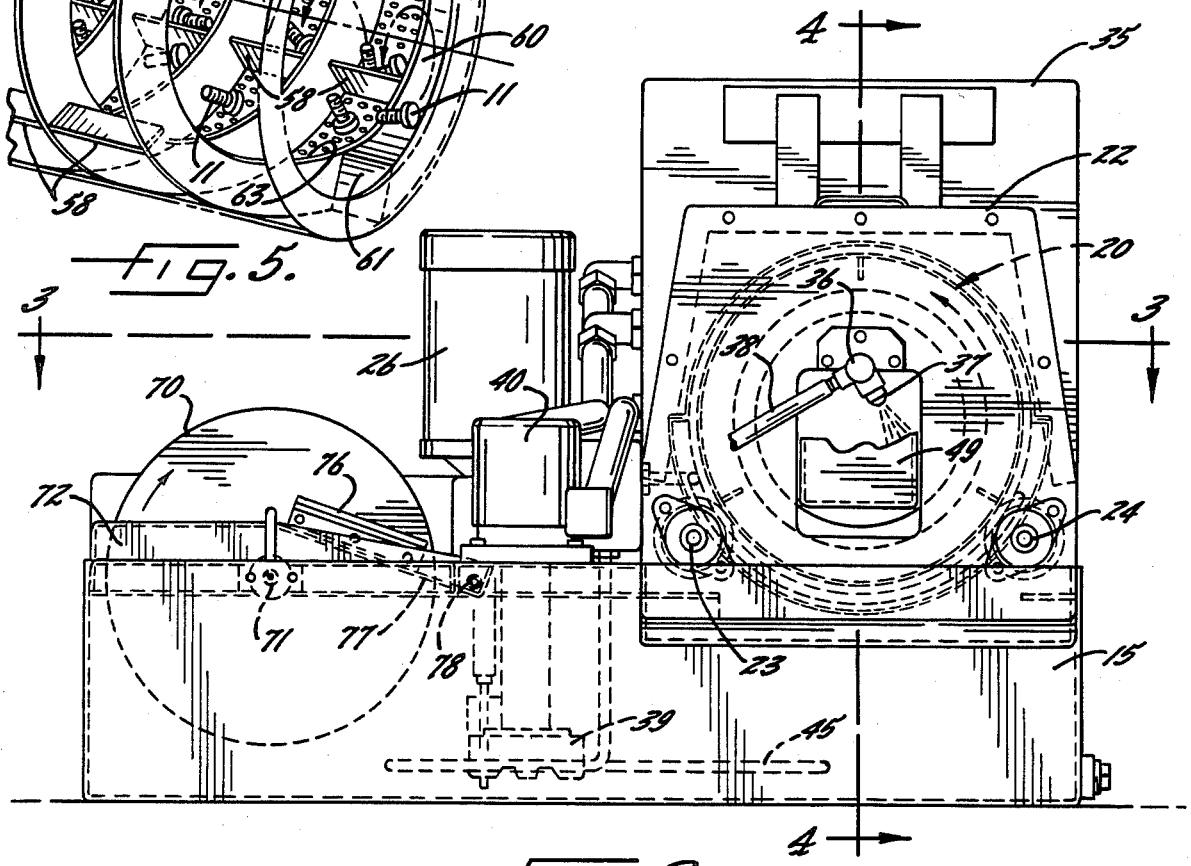
FIG. 2 is an elevational view of the machine as taken substantially along the line 2—2 of FIG. 1, certain parts being broken away and shown in section.

As shown in the drawings for purposes of illustration, the invention is embodied in a machine 10 for washing particulate workpieces which, in the present instance, have been shown as being newly formed threaded screws 11 (FIG. 5). During formation of the screws, the screws become coated with lubricant which must be removed before the screws proceed to subsequent manufacturing operations such as a plating operation.

Figure 3:
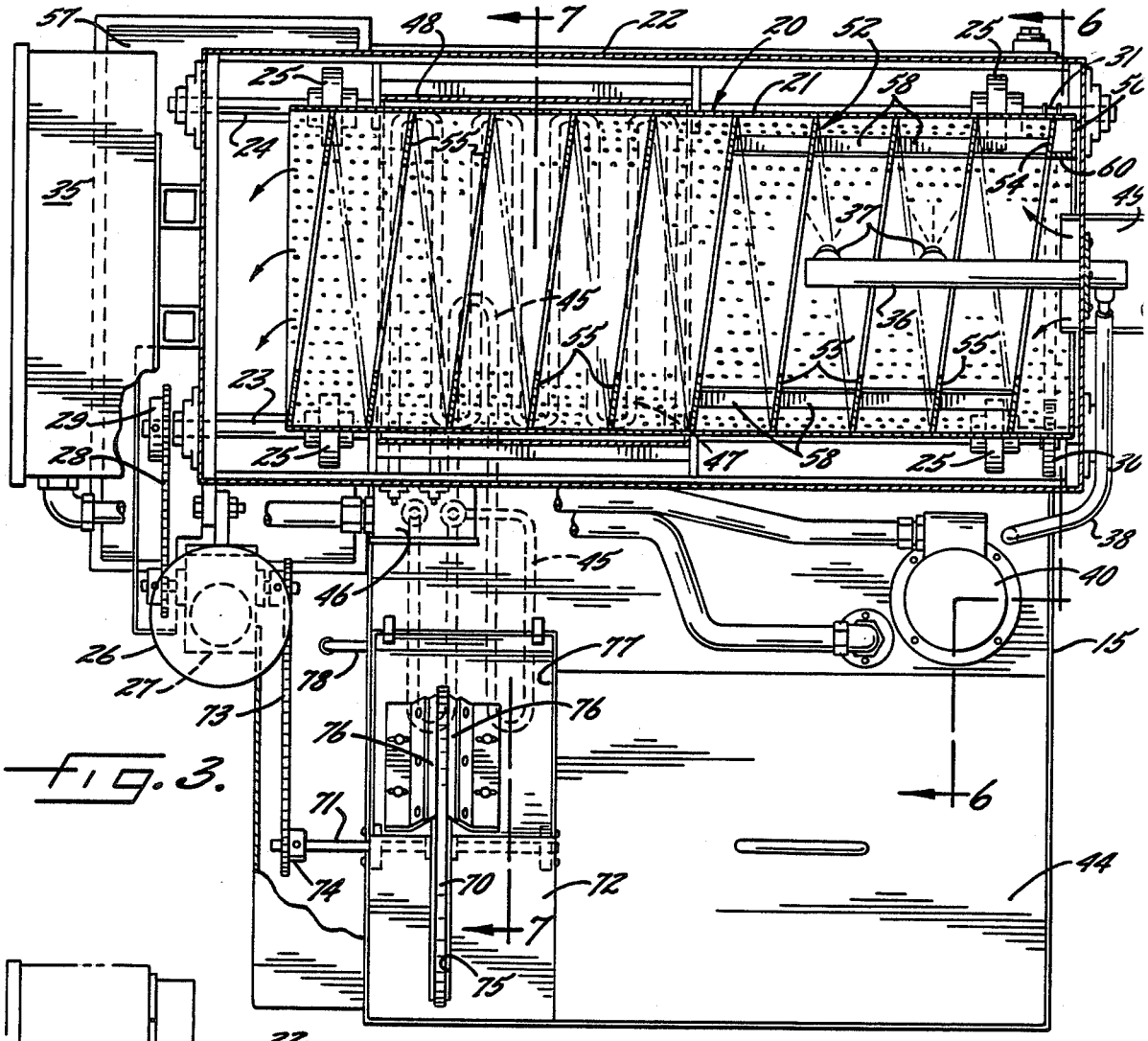
FIGS. 3 and 4 are fragmentary cross-sections taken substantially along the lines 3—3 and 4—4, respectively, of FIG. 2.

In general, the machine 10 comprises a lower sheet metal tank 15 defining a reservoir 16 (FIG. 4) for holding a suitable cleaning solution. Located above the tank is a rotatable drum 20 (FIGS. 3 and 4) adapted to hold a quantity of screws 11 and adapted to advance a continuous flow of screws axially within the drum as the drum rotates. During such advance, the screws are sprayed with cleaning solution and are subsequently dried before being discharged from the drum.

Figure 1:
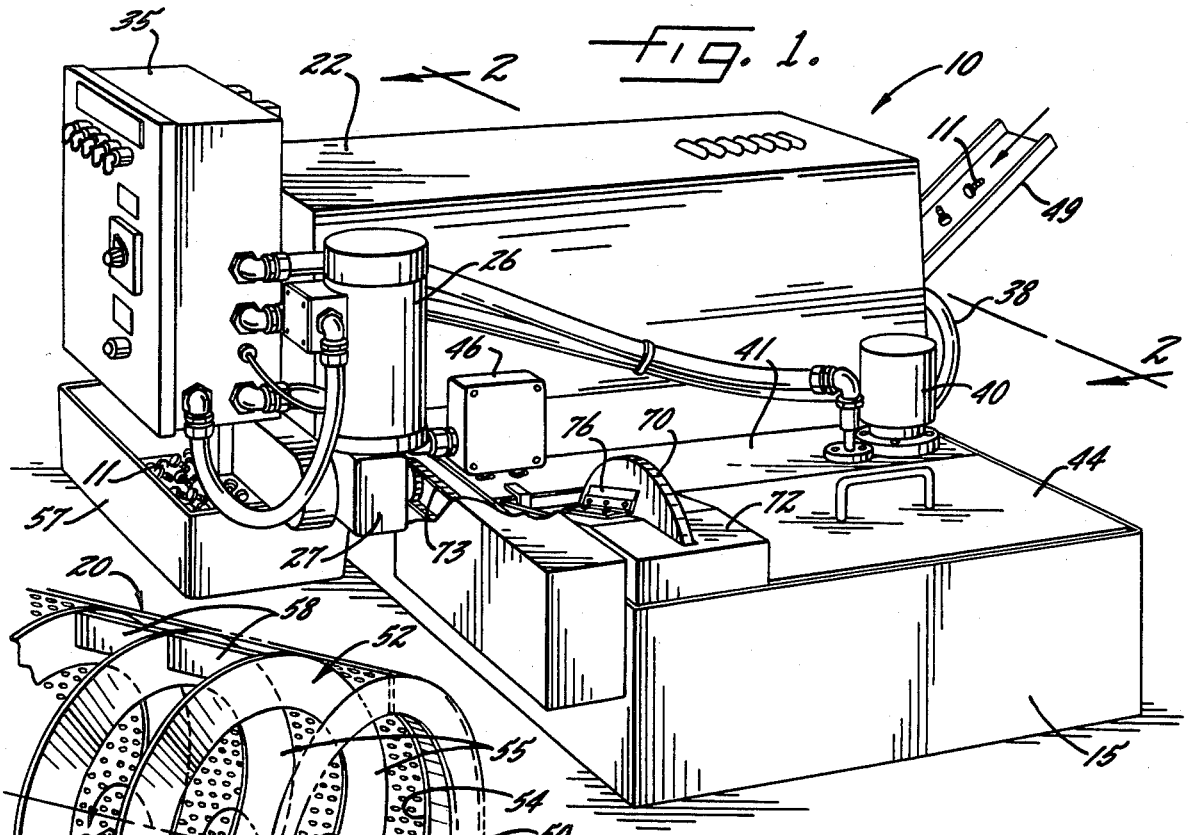
FIG. 1 is a perspective view of a new and improved parts washing machine incorporating the unique features of the present invention.

More specifically, the drum 20 includes an elongated tubular shell 21 which is enclosed by a box-like housing 22 and which is supported to rotate about a generally horizontal axis. For this purpose, two horizontal shafts 23 and 24 (FIG. 3) are journaled by the end walls of the housing 22 and extend along opposite sides of the drum 20 near the bottom thereof. Rollers 25 are located near the end portions of the drum and cradle the drum while supporting the drum to rotate about its own axis. To rotate the drum 20, an electric motor 26 (FIGS. 1 and 3) is supported on one side of the tank 15 and acts through a speed reducer 27 and a chain 28 to rotate a sprocket 29 secured rigidly to one end portion of the shaft 23. A pinion 30 (FIG. 6) is fastened to the other end portion of the shaft 23 and interacts with a chain 31 which is wrapped tightly around and is fastened securely to the adjacent end portion of the drum. When the motor 26 is energized by actuating the appropriate switch of a control box 35, the drum is rotated in a counterclockwise direction (FIG. 6) and at a relatively slow speed (e.g., 3 R.P.M.)

To wash the screws 11 in the drum 20, a spray bar 36 (FIGS. 3 and 4) extends from the housing 22 and into the upstream end portion of the drum, the bar being equipped with a pair of spray nozzles 37. A flexible conduit 38 extends from the spray bar to the outlet of a pump 39 (FIG. 6) which is submerged in the cleaning solution in the reservoir 16 and which is adapted to be driven by an electric motor 40 supported on a fixed cover 41 at the top of the tank 15. When the motor 40 is energized, the pump causes pressurized jets of cleaning solution to be sprayed from the nozzles 37 in order to clean lubricant from the screws 11. The shell 21 of the drum 20 is perforated and thus cleaning solution drains from the drum and back into the tank 15 after washing the screws 11. If the cooling solution falls below a predetermined level in the reservoir 16, a float-actuated switch 43 (FIG. 6) de-energizes the motor 40 to shut down the pump 39. To enable the reservoir 16 to be filled with cleaning solution, a removable cover 44 (FIG. 1) is supported on top of the tank 15.

Figure 4:
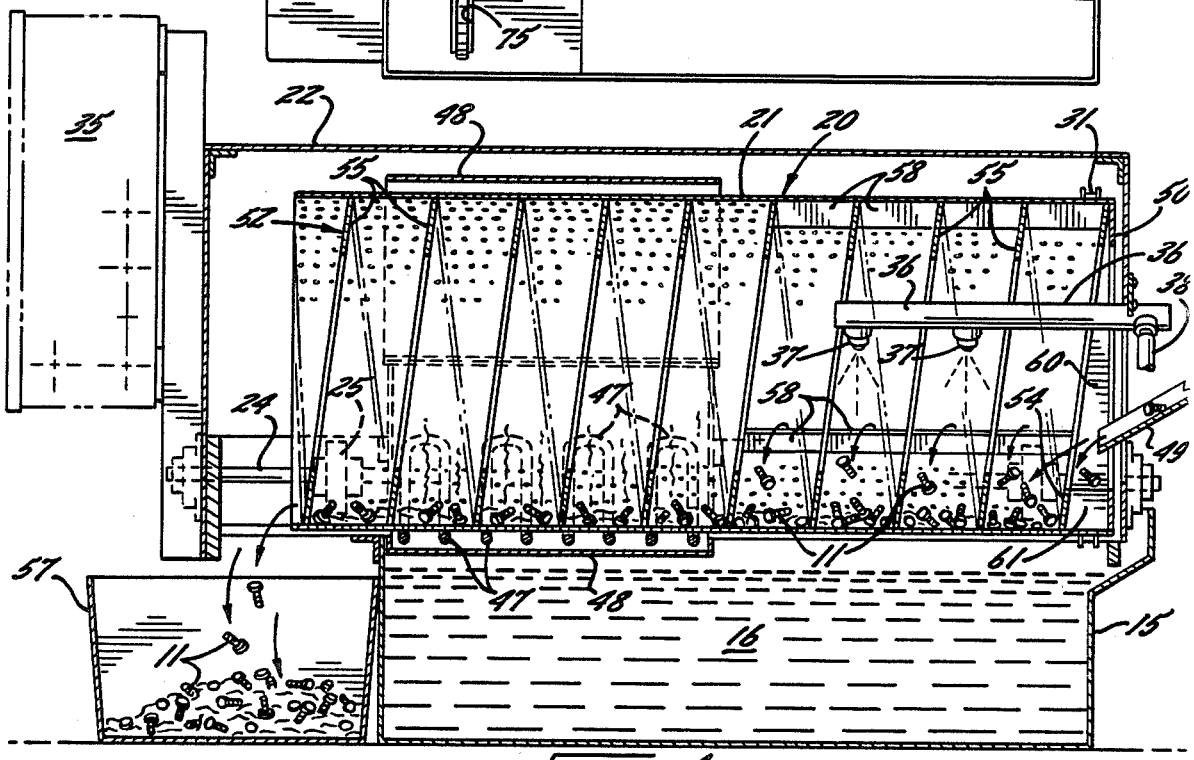
Figure 7:
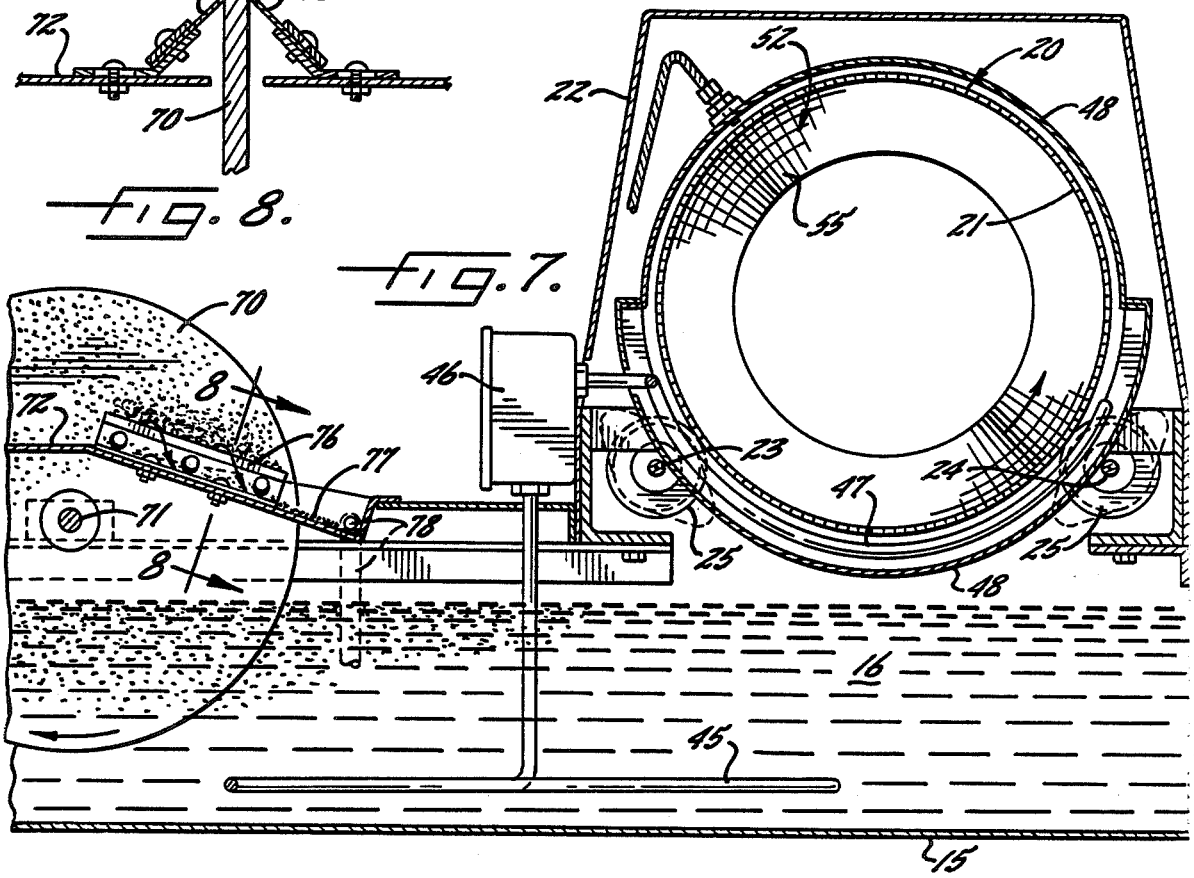

The cleaning solution in the tank 15 is adapted to be heated by an immersion heater 45 (FIG. 7) submerged in the reservoir 16 and energized by a power supply 46. Electric resistance heating coils 47 also are adapted to be energized by the power supply and act to dry the screws 11 before the latter are discharged from the drum 20. As shown in FIGS. 4 and 7, several axially spaced coils 47 curve beneath the downstream end portion of the drum and are adapted to radiate heat upwardly through the drum. To confine the heat within the drum, a stationary tubular heat shield 48 (FIG. 7) surrounds the coils 47 and the downstream end portion of the drum.

Screws 11 are delivered into the drum 20 by way of a downwardly inclined chute 49 which extends into the drum adjacent the upstream or entrance end thereof. The entrance end of the drum is defined by a sheet metal end ring 50 (FIGS. 4 and 5) joined to and projecting radially inwardly from the inner wall of the shell 21 and extending perpendicular to the axis of the drum 20.

To advance the screws 11 through the drum 20, a conveyor in the form of an annular helical flight 52 (FIG. 5) is secured to the inner wall of the shell 21 and extends around the drum along the entire length thereof. As shown in FIGS. 4 and 5, the helical flight 52 includes an initial turn 54 which starts immediately adjacent the inboard face of the end ring 50 and which curves helically around the inner wall of the shell 21. The initial turn merges continuously with a second turn 55 which is followed by identical helical turns, the last turn terminating near the extreme downstream end of the drum. When the drum 20 is rotated, the helical flight 52 continuously advances the screws 11 along the drum until the cleaned and dried screws reach the downstream end of the drum and fall out of the drum and into a collection box 57 (FIG. 4).

To promote thorough cleaning of the screws 11, the screws are tumbled and stirred as they travel through the upstream end portion of the drum 20 and past the spray nozzles 37. For this purpose, three angularly spaced sets of paddles 58 (FIGS. 4 and 5) are secured to the inner wall of the shell 21 and are located between the upstream turns of the helical conveyor flight 52. As the drum rotates, the paddles pick up the screws and carry the screws upwardly until the screws fall off of the paddles and back to the bottom of the drum. Such tumbling exposes all surfaces of the screws to the spray from the nozzles and promotes a scrubbing action between the screws to help remove lubricant.

In accordance with the primary aspect of the present invention, novel means are provided for preventing screws 11 from becoming trapped between the end ring 50 and the initial turn 54 of the conveyor flight 52. Herein, these means comprise a sheet metal shield 60 (FIGS. 3 to 6) which is curved in accordance with the curvature of the inner edge of the end ring 50 and with the curvature of the inner edge of approximately the first half of the initial turn 54 of the flight 52. As shown in FIG. 5, the initial turn 54 gradually progresses away from the end ring 50 as the initial turn helically winds around the inner wall of the shell 21. The shield 60 spans the inner edges of the end ring 50 and the initial turn 52 and covers the space therebetween. To cover all of such space, the shield starts at the very start of the initial turn and gradually increases in axial width as it progresses around the drum, the shield thus being generally triangular in a rolled out plan view. In this instance, the shield proceeds around the drum through an arc of about 180 degrees and then terminates. Preferably, a baffle 61 (FIGS. 5 and 6) formed integrally with the terminal end of the shield 60 spans the inner edges of the ring 50 and the initial turn 54 and extends generally radially outwardly between the shield and the inner wall of the shell 21 so as to close off the end of the space which is covered by the shield. The shield and the baffle may be spot welded at appropriate locations to the end ring and the initial turn.

Figure 6:
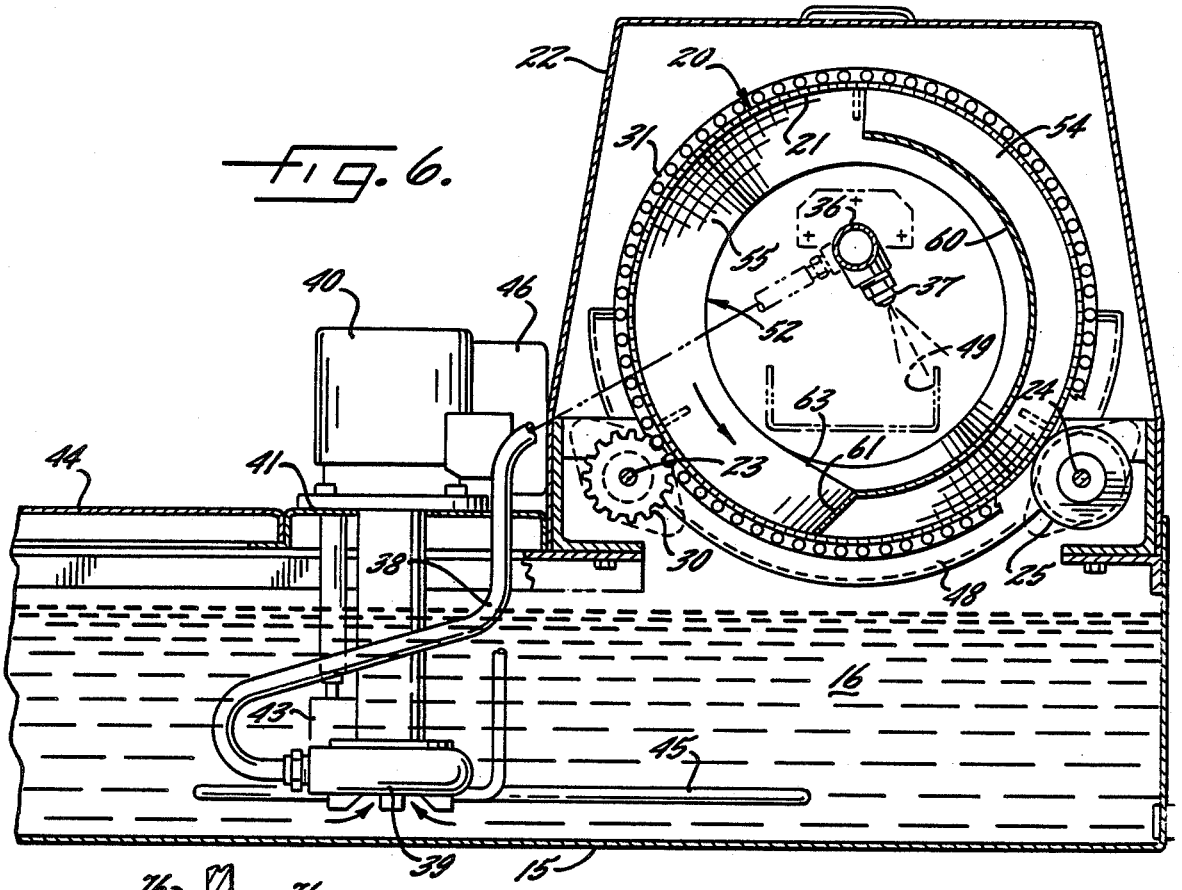
FIGS. 6 and 7 are fragmentary cross-sections taken substantially along the lines 6—6 and 7—7, respectively, of FIG. 3.

As shown most clearly in FIG. 6, the shield 60, the inner edge of the end ring 50 and the inner edge of the first half of the initial turn 54 are all curved on an equal radius which is significantly greater than the radius of curvature of the inner edge of the second turn 55 and the succeeding turns of the conveyor flight 52. To compensate for the difference in radii, the initial turn 54 is formed with a transition section 63 (FIG. 6) which begins immediately adjacent the baffle 61 and which causes the large radiused inner edge of the first half of the initial turn to gradually merge into the smaller radiused inner edge of the second half of the initial turn and of the succeeding turns.

Figure 8:
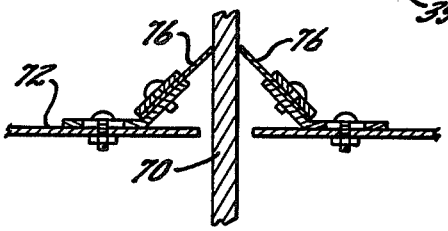
FIG. 8 is an enlarged fragmentary cross-section taken substantially along the line 8—8 of FIG. 7.

With the foregoing arrangement, screws 11 are delivered into the entrance end of the drum 20 and through the ring 50 by means of the chute 49. Because of the shield 60 and the baffle 61, screws are prevented from falling into and becoming trapped in the relatively narrow space between the end ring 50 and the first half of the initial turn 54 of the helical flight 52. Instead, the shield 60 deflects such screws past the first half of the initial turn and into position where the screws may be engaged either by the second half of the initial turn or by the second turn 55 for advancement through the drum. Thus, the shield prevents screws from being trapped and causing a jam at the entrance end of the drum and, at the same time, eliminates the need for the chute 49 to extend any significant distance into the drum. The baffle 61 closes off the space at the end of the shield 60 and prevents screws from rolling along the inner wall of the shell 21 and into such space. The present invention also contemplates the provision of relatively simple means for removing oil and other lubricants from the cleaning solution which is recycled from the drum 20 to the reservoir 16. In this instance, these means comprise a disc 70 (FIGS. 7 and 8) made of phenolic resin or other suitable material which has affinity for lubricants. The disc 70 is supported to rotate with a horizontal shaft 71 (FIG. 3) which is journaled by a housing 72 located near the top of the tank 15. A chain 73 (FIGS. 1 and 3) extends from the speed reducer 27 to a sprocket 74 on the shaft 71 and is operable to rotate the disc 70 when the motor 26 is energized.

As shown in FIG. 7, the lower portion of the disc 70 is submerged in the cleaning solution in the reservoir 16 while the upper portion of the disc projects upwardly through a slot 75 (FIG. 3) in the housing 72. The phenolic disc attracts oil in the cleaning solution and, when the disc is rotated in a clockwise direction as shown in FIG. 7, the oil which accumulates on the disc is carried to a position above the housing 72. Removal of the oil from the disc is effected by a pair of downwardly inclined squeegee blades 76 (FIG. 8) which press against opposite sides of the disc 70, the blades being mounted on the housing 72. Part of the top of the housing 72 defines a downwardly inclined pan 77 (FIG. 7) which catches the oil scraped off of the disc 70 by the blades 76 and directs the oil to a drain pipe 78 located near the lower end of the pan. In this way, oil is continously removed from the cleaning solution during operation of the drum 20 so as to enable the cleaning solution to remain effective for a longer period of time before requiring changing.

I claim:

1. Apparatus for cleaning contaminants from particulate workpieces, said apparatus comprising an elongated drum supported to rotate about a generally horizontal axis coinciding with the axis of the drum, means for rotating said drum about said axis, said drum having a workpiece entrance end and a workpiece discharge end, means for delivering particulate workpieces into said drum adjacent the entrance end thereof, an annular helical conveyor secured to the inner wall of said drum and extending around and along said wall from the entrance end of the drum toward the discharge end thereof to advance said workpieces axially within said drum in response to rotation of said drum about said axis, means in said drum for spraying said workpieces with a cleaning solution as the workpieces are advanced within the drum, an end ring joined to said drum at the entrance end thereof and extending substantially perpendicular to the axis of said drum, said ring extending inwardly from the inner wall of said drum, said conveyor comprising a continuous helical flight having an initial turn starting adjacent said end ring and gradually proceeding axially away from said end ring, and means for preventing parts from becoming trapped in the space between said end ring and the initial turn of said conveyor flight, said last-mentioned means comprising a shield spanning the inner edge portions of part of said end ring and said initial turn and covering the space therebetween, said shield starting at the start of said initial turn and gradually increasing in width upon proceeding around said drum through less than one revolution to a terminal end, and a baffle spanning said end ring and said initial turn and extending generally radially between the terminal end of said shield and the inner wall of said drum to close off said space whereby said shield and said baffle prevent workpieces delivered into said drum from entering said space.

2. Apparatus as defined in claim 1 in which said shield and the inner edge of said conveyor flight are curved and in which the radius of said shield is approximately equal to the radius of the adjacent portion of the inner edge of said initial turn whereby said shield and the adjacent inner edge of said initial turn are substantially flush, the inner edges of the remaining turns of said conveyor flight having a smaller radius than said shield, and said initial turn having a transition section which causes a gradual merger of the initial turn adjacent said shield with the turn beyond said baffle.

3. Apparatus as defined in claim 1 in which said shield extends around the inner wall of said drum through an arc of about 180 degrees.

4. Apparatus as defined in claim 1 further including angularly spaced paddles secured rigidly to the inner wall of said drum and extending between several turns of said conveyor flight to pick up and drop said workpieces during rotation of said drum and thereby cause said workpieces to tumble in said drum as the workpieces are advanced through the drum.

5. Apparatus as defined in claim 1 in which said drum is located above a tank defining a reservoir for said cleaning solution, said spraying means discharging cleaning solution into said drum for flow through said drum, past said workpieces and into said tank, a disc rotatable about a horizontal axis in said tank with the lower portion of the disc submerged in the cleaning solution in the tank and with the upper portion of the disc located above the level of the cleaning solution in the tank, said disc being made of a material capable of attracting contaminants in said cleaning solution, means for rotating said disc, and means for scraping contaminants from the upper portion of said disc as the disc is rotated and for discharging such contaminants from said tank.

6. Apparatus as defined in claim 5 in which said scraping and discharge means comprise a pair of squeegee blades located in contact with opposite sides of said disc, and a discharge trough underlying said blades.

7. Apparatus for cleaning lubricant from particulate workpieces, said apparatus comprising a tank defining a reservoir for cleaning solution, an elongated perforated drum supported above said reservoir to rotate about a generally horizontal axis coinciding with the axis of the drum, means for rotating said drum about said axis, said drum having a workpiece entrance end and a workpiece discharge end, means for delivering particulate workpieces into said drum adjacent the entrance end thereof, conveyor means secured to the inner wall of said drum and operable to advance said workpieces axially within said drum in response to rotation of the drum about said axis, means in said drum for spraying said workpieces with cleaning solution to remove lubricant therefrom as the workpieces are advanced within the drum, the cleaning solution and the removal lubricant draining out of the perforated drum and into said tank, a disc rotatable about a horizontal axis in said tank with the lower portion of the disc submerged in the cleaning solution in the tank and with the upper portion of the disc located above the level of the cleaning solution in the tank, said disc being made of a material capable of attracting lubricant contained in said cleaning solution, means for rotating said disc, and means for scraping lubricant from the upper portion of said disc as the disc is rotated and for discharging such lubricant from said tank.

8. Apparatus as defined in claim 7 in which said scraping and discharge means comprise a pair of squeegee blades located in contact with opposite sides of said disc, and a discharge trough underlying said blades.

9. Apparatus as defined in claim 7 in which said spraying means extend only part way into said drum adjacent the entrance end portion thereof, and drying means located downstream of said spraying means and adjacent the discharge end portion of said drum for drying said workpieces after the latter have been sprayed with cleaning solution.

10. Apparatus as defined in claim 9 in which said drying means comprise electrically heated coil means surrounding the discharge end portion of said drum.

11. Apparatus as defined in claim 10 further including a tubular heat shield surrounding said coil means.

12. Apparatus as defined in claim 7 further including a motor, said means for rotating said drum and said means for rotating said disc both being driven by said motor.

13. Apparatus as defined in claim 7 in which said conveyor means comprise an annular helical conveyor extending around and along the inner wall of said drum from the entrance end of said drum toward the discharge end thereof, an end ring joined to said drum at the entrance end thereof and extending substantially perpendicular to the axis of said drum, said end ring extending inwardly from the inner wall of said drum, said conveyor comprising a continuous helical flight having an initial turn starting adjacent said end ring and gradually proceeding axially away from said end ring, and means for preventing parts from becoming trapped in the space between said end ring and the initial turn of said conveyor flight, said last-mentioned means comprising a shield spanning the inner edge portions of part of said end ring and said initial turn and covering the space therebetween, said shield starting at the start of said initial turn and gradually increasing in width upon proceeding around said drum through less than one revolution to a terminal end, and a baffle spanning said end ring and said initial turn and extending generally radially between the terminal end of said shield and the inner wall of said drum to close off said space whereby said shield and said baffle prevent workpieces delivered into said drum from entering said space and direct such workpieces to the space between said initial turn and the succeeding turn of said conveyor.

* * * * *